US007159570B2

(12) United States Patent
Zdroik

(10) Patent No.: US 7,159,570 B2
(45) Date of Patent: Jan. 9, 2007

(54) FUEL INJECTOR RETENTION CLIP

(75) Inventor: Michael J. Zdroik, Metamora, MI (US)

(73) Assignee: Millennium Industries Corp., Auburn Hills, MI (US)

( * ) Notice: Subject to any disclaimer, the term of this patent is extended or adjusted under 35 U.S.C. 154(b) by 195 days.

(21) Appl. No.: 11/003,059

(22) Filed: Dec. 3, 2004

(65) Prior Publication Data

US 2006/0118091 A1 Jun. 8, 2006

(51) Int. Cl.
*F02M 55/02* (2006.01)

(52) U.S. Cl. ..... 123/470; 239/600

(58) Field of Classification Search ..... 123/470
See application file for complete search history.

(56) References Cited

U.S. PATENT DOCUMENTS

| | | | | |
|---|---|---|---|---|
| 5,167,213 | A | 12/1992 | Bassler et al. | 123/470 |
| 5,803,052 | A | 9/1998 | Lorraine et al. | 123/470 |
| 6,019,089 | A | 2/2000 | Taylor et al. | 123/470 |
| 6,668,803 | B1 | 12/2003 | McClean et al. | 123/470 |

*Primary Examiner*—Andrew M. Dolinar
(74) *Attorney, Agent, or Firm*—Dykema Gossett PLLC

(57) ABSTRACT

A fuel delivery system arrangement is provided which includes a clip having an inner circumferential surface which engages the fuel injector body but has an outer circumferential surface which is inserted within the fuel rail injector cup outlet. Therefore an inadvertent torque placed upon the fuel injector will cause the outer diameter of the clip to engage the interior of the cup and thereafter be prevented from opening.

19 Claims, 5 Drawing Sheets

FUEL INJECTOR RETENTION CLIP

FIELD OF THE INVENTION

The invention relates to a fuel delivery system arrangement for connecting an electric operated fuel injector between a fuel rail and an air intake of a spark-ignited, internal combustion engine.

BACKGROUND OF THE INVENTION

Spark-ignited, fuel-injected internal combustion engines are often used in automotive vehicles. Fuel is injected into an intake system of such an engine by electric operated fuel injectors of a fuel rail (sometimes referred to as a fuel manifold) assembled to the engine.

Targeted types of fuel injectors inject fuel into the vehicle engine in a direction, or directions, that are other than along the fuel injector axial centerline. A split stream fuel injector is an example of a targeted fuel injector. When a targeted fuel injector is used in an engine, the fuel injector has to have a particular angular or circumferential orientation about its centerline so that the direction(s) of fuel injection will be properly targeted. Improperly targeted fuel injectors may derogate engine performance and/or compliance with applicable vehicle emission requirements.

Proper targeting of a fuel injector typically requires a proper axial positioning of the fuel injector. This is typically achieved by positioning the fuel injector nozzle, which contains one or more metering orifices from which fuel is injected into an engine, in a fixed geometric relation to a socket receptacle of the engine intake system into which the nozzle is inserted in a sealed manner. When a fuel rail containing fuel injectors that have been properly circumferentially located in respective outlet cups of the fuel rail is assembled to an engine that has injector-receiving socket receptacles, the act of inserting the nozzles into properly sealed relationship with the socket receptacles can complete proper targeting of the fuel injectors. The achievement of the correct circumferential location of the fuel injector to the fuel rail outlet cup is referred to as "clocking" the fuel injector.

A fuel rail may comprise attachment features, aperture brackets for example, with which threaded fasteners are associated to fasten the fuel rail to an engine. Once the fuel injector nozzles have seated in properly targeted positions in the socket receptacles, a need for further tightening of such fasteners in order to secure the fuel rail to the engine may induce undesired stress, distortion and/or movement. For example, if fuel injector nozzles have been seated in properly targeted positions in respective socket receptacles in engine air intake manifold runners before the fuel rail attachment fasteners have been fully torqued, the fuel rail may distort in some way, and/or there may be some relative movement between some component parts, as the fasteners are finally tightened to full installation torque. With prevailing manufacturing methods and dimensional tolerances of manufactured parts, it seems that the possibility of such distortion, or movement of component parts, at time of fuel rail assembly to an engine, cannot be totally foreclosed in all circumstances.

It has been known to mechanically retain a fuel injector in a fuel rail outlet cup by a retention clip that constrains the two against any substantial movement, both circumferentially and axially. A fuel rail that incorporates such a capability may improve serviceability should it become necessary to remove the fuel rail from an engine and thereafter reattach it.

Due to the enhanced stringency of vehicle emission requirements and the use of four valve cylinder heads with two intake ports, it is now more important than ever to insure the fuel injectors are properly clocked. Therefore the requirements that fuel injectors be properly clocked when inadvertently twisted during assembly or maintenance operations are greater than that previously required. Many prior fuel delivery system arrangements retain the fuel injector to the cup with a double C-type clamp clip. The double C-type clamp clip has a primary C clamp which engages an arcuate slot of the injector body. The primary C clamp retains the injector body in a generally axial direction. A secondary C clamp is typically provided which extends generally perpendicular from the primary C clamp. The secondary C clamp typically has slots or projections which interact with a flange portion of an outlet cup to make it a click-on type connection. The secondary C clamp will typically have a contact surface to prevent rotation of the fuel injector body with respect to the fuel injector outlet other than its desired angular position. An example of such a clip is shown in U.S. Pat. No. 5,040,512.

There has been a tendency from many of the prior clips to lose their retention with the fuel injector body when the fuel injector is inadvertently twisted during a maintenance operation or during a misassembly.

It is desirable to provide an improved fuel delivery system wherein the clip is less susceptible to being splayed open whenever a fuel injector is torqued inadvertently.

SUMMARY OF THE INVENTION

The fuel delivery system arrangement of the present invention provides a clip having an inner circumferential surface which engages the fuel injector body but has an outer circumferential surface which is inserted within the fuel rail injector cup outlet. Therefore an inadvertent torque placed upon the fuel injector will cause the outer diameter of the clip to engage the interior of the cup and thereafter be prevented from opening as in prior clip designs.

Other features of the invention will become more apparent from a review of the ensuing drawings and description.

DETAILED DESCRIPTION OF THE INVENTION

Figure 1:
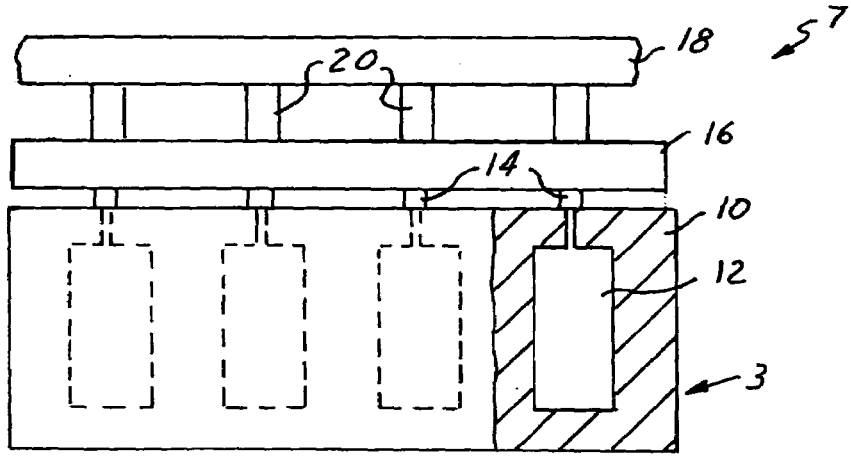
FIG. 1 is a schematic view of the internal combustion engine of the present invention.

FIG. 1 illustrates a spark-ignited, internal combustion vehicle engine 3 having an arrangement of a fuel delivery system 7 according to the present invention. The vehicle engine 3 as schematically shown has an engine block 10. The engine block 10 has a bank of combustion chambers 12. The combustion chambers 12 are fluidly connected with runners 14 of an air intake manifold 16. Connected between the air intake manifold 16 and a pressurized fuel rail 18 are a series of fuel injectors 20. The fuel injectors 20 meter fuel from the fuel rail 18 to the runners 14. In another embodiment of the present invention (not shown), the fuel injectors 20 are inserted with a passage connecting them directly with the combustion chambers 12. Typically the fuel rail 18 will be connected to the intake manifold 16 by a series of brackets (not shown). The fuel injectors 20 are typically top feed electric operated type fuel injectors. The fuel injectors may be single or multiple orifice type fuel injectors and typically will be directional type fuel injectors wherein the angular position of the fuel injectors about its longitudinal axis should be aligned with a predetermined direction to ensure proper delivery of fuel into the runners 14 of the air intake manifold 16.

Referring additionally to FIGS. 2, 3, 4 and 5 the fuel delivery system 7 of the present invention as mentioned previously includes the fuel rail 18. The fuel rail 18 has an outlet opening 24. An outlet cup 26 has a narrow portion 28 and is sealably inserted within the aforementioned fuel rail outlet opening 24. The outlet cup 26 also has an enlarged portion 30. Towards a bottom outlet end, the outlet cup 26 has a flange 32. In the embodiment shown, the flange 32 is generally perpendicular but in other embodiments the flange can be angled upward (FIGS. 6 and 7) or downward (not shown). The flange 32 of the outlet cup has a slot 34. The slot 34 also extends to a short portion of the enlarged portion 30 which is most adjacent to the flange 32.

The fuel injector has a body inlet portion 40 which has an inlet opening 42 extending therethrough. The inlet portion 40 is insertable within the cup 26. An O-ring 44 is sealably engaged with the inlet portion 40 of the fuel injector and additionally is sealably engaged with an interior inner diameter 46 of the cup. A mid portion 48 of the injector has slot grooves 50 (FIG. 5) providing flats 52. A bottom end 54 of the fuel injector body is sealably mounted by an O-ring 56 within an opening 58 of the intake manifold 16 which intersects with the runner 14.

The fuel delivery system includes an arcuate clip 60. The clip 60 functions to radially and axially retain the fuel injector 20 to the cup 26 and also functions to clock or to angularly orientate the fuel injector 20 to ensure its proper angular positional alignment along its longitudinal axis. The clip 60 has an outer periphery or circumference 62. The outer circumference 62 will be sized to be slightly greater than that than the inner diameter 46 of the cup when the clip is in its free state and slightly less when circumferentially compressed for insertion into the cup 26. The clip 60 has an inner peripheral or circumferential surface 64. The inner circumferential surface 64 of the clip has non-relative torsional engagement with the mid portion 48 of the fuel injector. The inner circumferential surface 64 has flats 66 which engage the flats 52 of the injector body. The clip 60 has an open end between the contact points 68. The distance between the contact points 68 will typically be slightly less than or the same as the width between the flats 52 of the injector body mid portion and the injector body mid portion will only come within the interior of the clip 60 by spreading apart the contact points 68. The clip 60 also has radially extending arms 70. Radially extending arms 70 each have two fingers 72 which are positioned on top of the cup flange 32.

During the assembly operation the contact points 68 are spread apart or wedged apart and ride upon the flats 52 of the fuel injector body until such time that the flats 66 are allowed to engage with the flats 52. A top or extreme sectional end of the injector body mid portion noted as item 76 (FIG. 3) can be purposely cut off so that the flats 66 cannot engage with the flats 52. Therefore an assembler by tactual touch alone will have confirmation that the fuel injector is not properly clocked and will therefore turn the fuel injector around 180 degrees to ensure its proper orientation with respect to the clip 62. The clip will be slightly compressed by appropriate tooling after being engaged with the fuel injector mid portion. The arms 70 are then aligned with the slots 34 of the injector cup and the arm 70 and finger 72 are deformed to place a orifice contact surface 78 on top of the flange 32. The fuel injector will be clocked in the correct position and the finger with contact with the flange 32 will axially and radially retain the fuel injector body in position. The slot floor and ceiling is juxtaposed by the thickness of the clip 60. The height of the slots 50 over and above that of the vertical height of the clip 60 will determine the axial play of the fuel injector with respect to the fuel rail 18.

Any inadvertent attempt to twist the fuel injector 20 will cause the clip to open up and engage the interior diameter 46 of the cup. The clip 60 will not be allowed to open up to release the fuel injector 20 unless it or the cup 26 is deformed, which will require substantial force. To release the fuel injector 20 for maintenance, the arms and fingers 72 will be deformed and removed through the slots 34.

Figure 6:
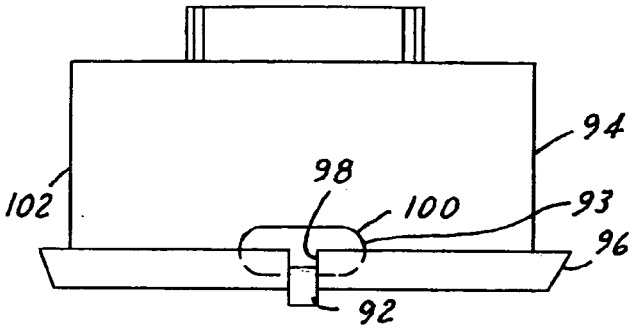
FIG. 6 is a partial side elevational view of an alternate preferred embodiment fuel delivery system according to the present invention.
Figure 7:
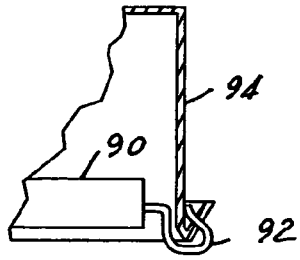
FIG. 7 is a partial sectional view of the fuel delivery system shown in FIG. 6.

Referring to FIGS. 6 and 7 an alternate preferred embodiment of the present invention has a clip 90. Clip 90 is substantially similar to clip 60 except it has a descending arm 92. A cup 94 utilized with the clip 90 has a generally upward angle flange 96 with a slot 98. The arm 92 has two projecting fingers 93 which nest between the flange 96 and the enlarged portion 102 of the cup.

Figure 2:
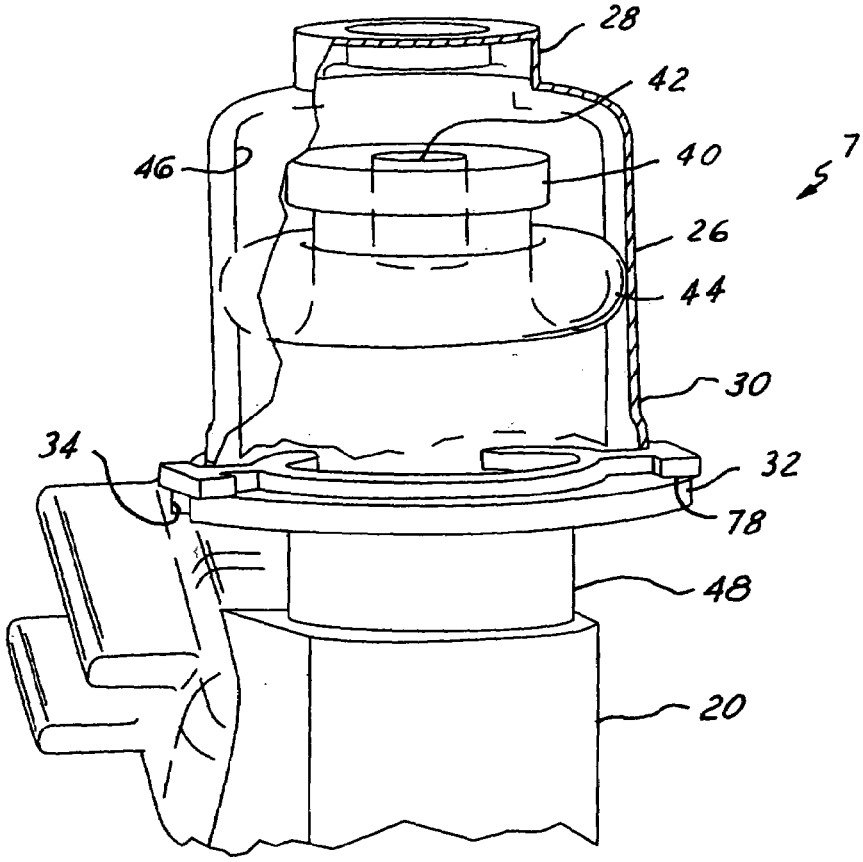
FIG. 2 is an enlarged perspective partially sectioned view of the fuel delivery system shown in FIG. 1.
Figure 4:
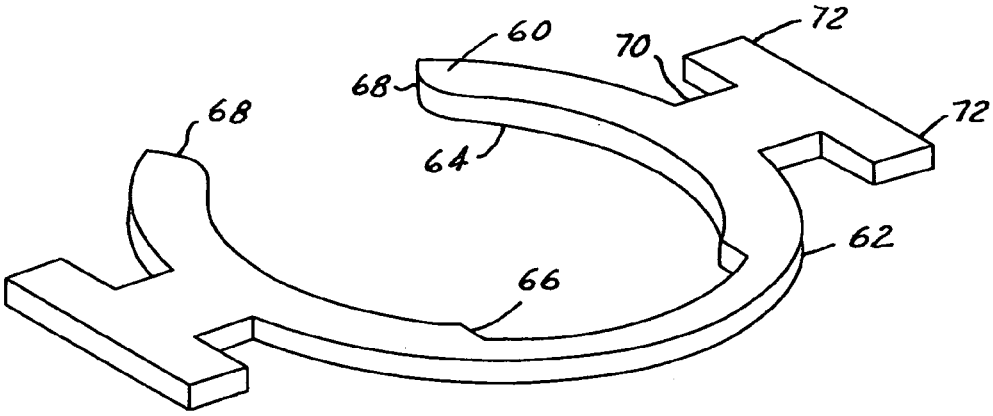
FIG. 4 is a perspective view of a clip utilizing the fuel delivery system shown in FIGS. 1–3.
Figure 3:
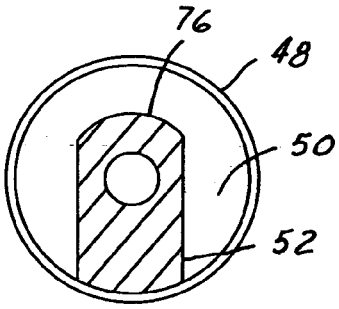
FIG. 3 is a sectional view of a fuel injector shown in FIGS. 1 and 2.
Figure 5:
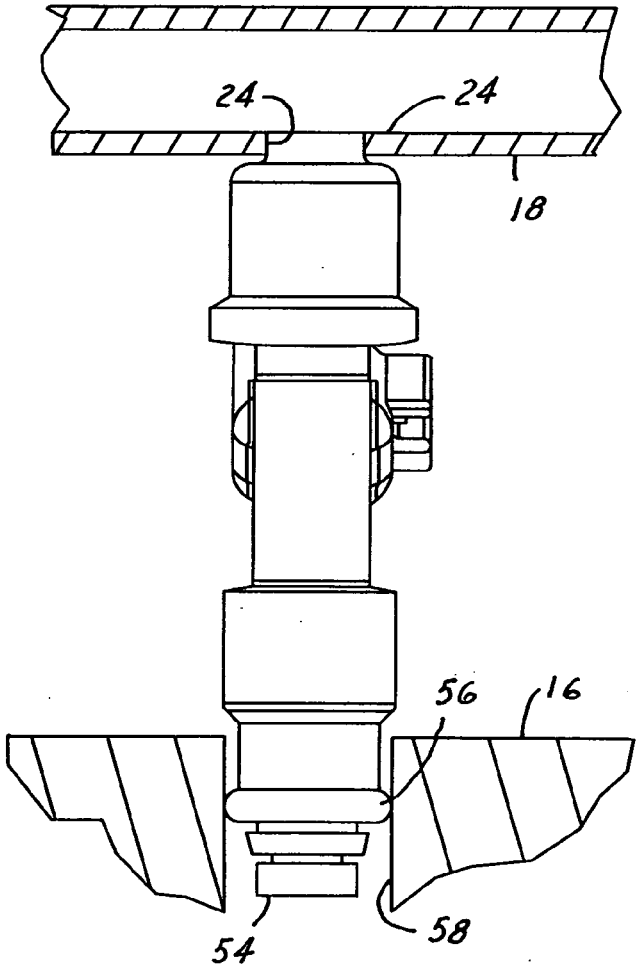
FIG. 5 is a perspective partially sectioned view of the fuel delivery system shown in FIGS. 1–4.
Figure 8:
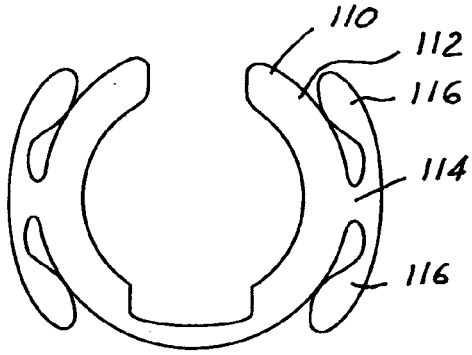
FIG. 8 is a top plan view of an alternate preferred embodiment clip to that shown in FIG. 4.
Figure 9:
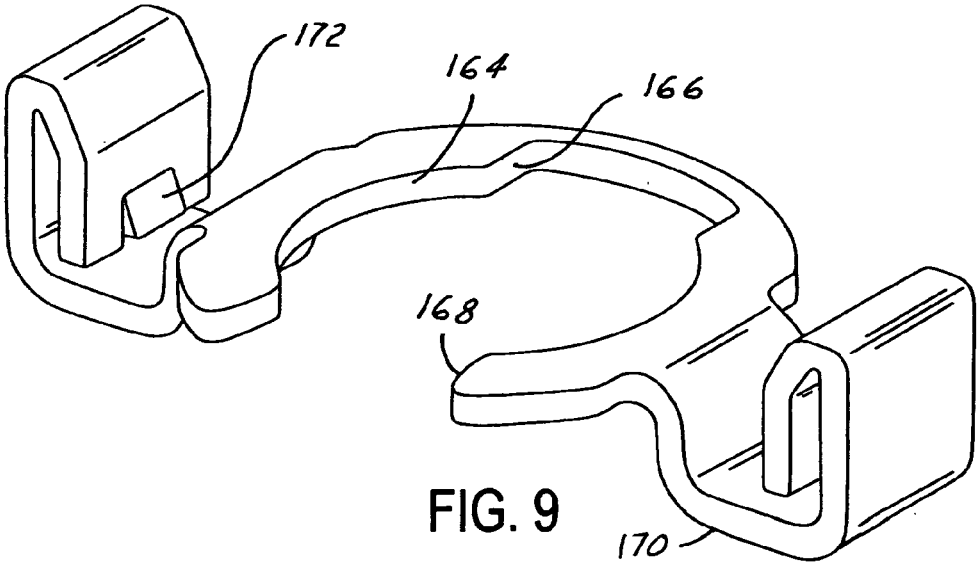
FIG. 9 is a perspective view of another alternative preferred embodiment clip to that shown in FIG. 4.
Figure 10:
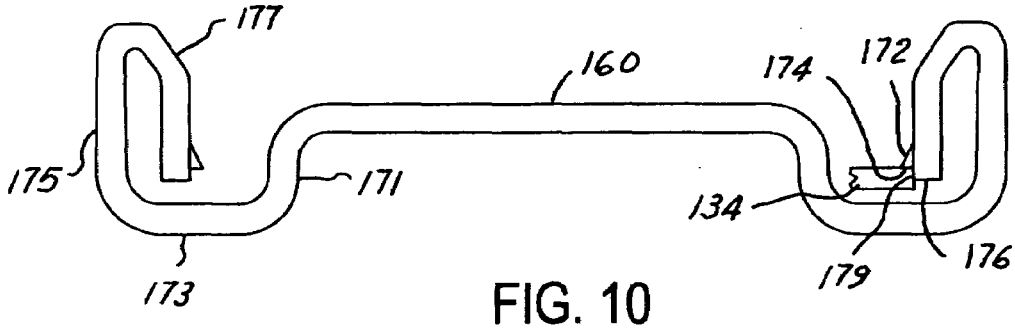
FIG. 10 is a side elevational view of the clip shown in FIG. 9.
Figure 11:
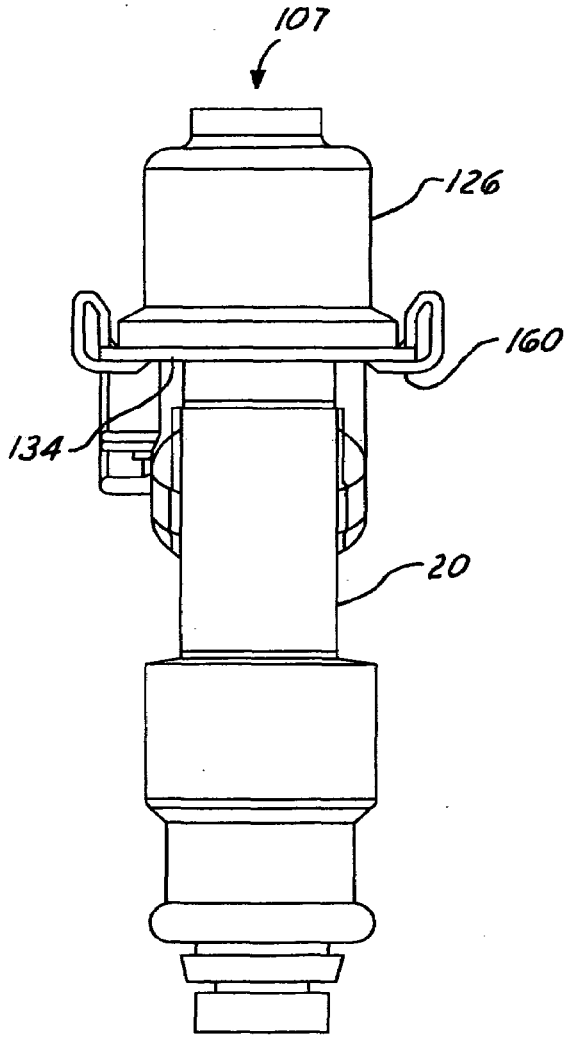
FIG. 11 is an elevational view of the clip shown in FIGS. 9–10 utilized to retain a fuel injector to a fuel rail outlet cup with portions of the cup removed for clarity of illustration.

Referring to FIG. 8 an alternate preferred embodiment clip 110 has a main body 112 substantially similar to that aforedescribed for the clip 60. The clip 110 is used with a cup 26, as shown in FIGS. 2 and 5. Additionally, the clip 60 has arms 114 having spring fingers 116. The fingers 116 compliantly engage against the outer perimeter of the cup enlarged portion 30 while additionally resting upon the cup flange 32.

Referring to FIGS. 9–12, an alternate preferred embodiment fuel delivery system includes a clip 160. The clip 160 functions to radially and axially retain a fuel injector 120 to the cap 126 and also functions to clock or to angularly orientate the fuel injector 120 to insure its proper alignment along its longitudinal axis. The clip 160 has an outer periphery 162, an inner peripheral surface 164, flats 166 and an open end between contact points 168, essentially similar to or identical to the aforedescribed items in regards to the clip 60 previously described.

Clip 160 has radially extending arms 170 which include a downwardly extending portion 171, a base portion 173, an upward extending portion 175 and a downwardly extending portion 177. The arms have a flared finger 172 which has a generally horizontal downward facing contact surface 174. The shoulder also provides a generally vertical radially inward contact surface 179.

Figure 12:
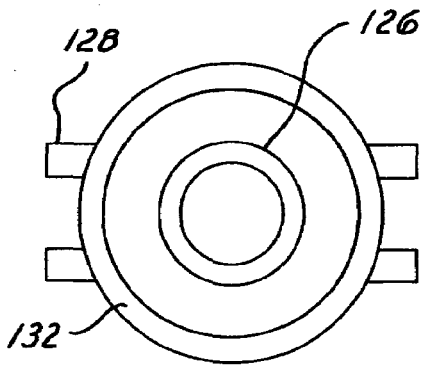
FIG. 12 is a top plan view of the fuel rail cup utilized in the fuel delivery system shown in FIG. 11.

The cup flange 132 has generally radial projections 128 (shown only in FIG. 12). The projections 128 set the radial position of the clip 160 with respect to the cup 126. The arms 170 have spring engagement with the flange 132 of the cup and the spring engagement has both a vertical and horizontal component due to the contact of the contact surfaces 177, 174 with the flange 132. When it is desirable to disassemble a fuel injector from the fuel rail, the downward extending portion 177 of the clip can be pushed outward to release the clip from the cup flange 130.

Figure 13:
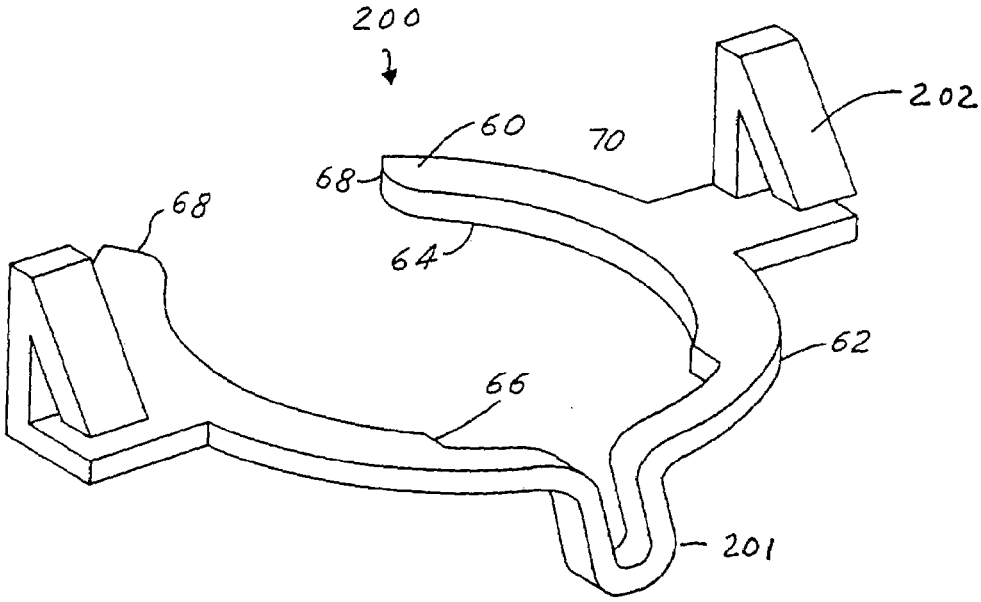
FIG. 13 is a perspective view of another alterative preferred embodiment clip to that shown in FIG. 4.

Referring to FIG. 13 an alternate preferred embodiment clip 200 is provided. The clip 200 has a wishbone bend 201 the bend 201 allows the clip to be removable by hand or without the use of specialized tooling. The wishbone bend 201 also allows the clip 200 to bend without permanent deformation therefore it can be reused. The clip 200 has bent over arms 202 which after installation extend over the top of the flange. The reminder to the clip 200 is similar if not identical to the clip 60.

While embodiments of the present invention have been explained it will be readily apparent to those skilled in the art of the various modifications and changes which can be made from the present invention without departing from the spirit and scope of the accompanying claims.

The invention claimed is:

1. A fuel delivery system comprising:

a fuel rail having a cup outlet, said cup having a flange;

a fuel injector having a body with an inlet insertable within said cup;

an arcuate clip having an outer peripheral surface for insertion within said cup and said clip having an inner peripheral surface for non-relative tortional engagement with said fuel injector body, said clip having at least one radially extending arm with a contact surface with said cup flange to limit radial movement of said clip with respect to said cup.

2. A fuel delivery system as described in claim 1, wherein said clip has two arms.

3. A fuel delivery system as described in claim 1, wherein said cup flange has a slot and said arm extends through said slot.

4. A fuel delivery system as described in claim 3, wherein said slot of said flange extends into a portion of said cup adjacent said flange.

5. A fuel delivery system as described in claim 1, wherein said arm contact surface includes a finger having spring engagement with said cup.

6. A fuel delivery system as described in claim 1, wherein said clip arm has a contact surface with said cup to limit axial movement of said clip with respect to said cup.

7. A fuel delivery system as described in claim 1 wherein said clip axially retains said fuel injector body.

8. A fuel delivery system as described in claim 1 wherein said clip arm has contact surfaces with a top surface of said cup flange.

9. A fuel delivery system as described in claim 8 wherein said arm of said clip has spring engagement with said cup.

10. A fuel delivery system as described in claim 1 wherein said cup has a projection to radially restrain said clip arm.

11. A fuel delivery system as described in claim 1 wherein said clip inner peripheral surface cannot be engaged with said fuel injector body unless said fuel injector body is in orientation to be properly clocked with respect to said fuel cup outlet.

12. A fuel delivery system comprising:

a fuel rail having a cup;

a fuel injector having a body with an inlet insertable with said cup;

an arcuate clip having an outer peripheral surface for insertion within said cup and said clip having an inner peripheral surface for non-rotative tortional engagement with said fuel injector body, said clip having a radially outward extending arm with a contact surface for engagement with a contact surface of said cup to limit said axial movement of said clip with respect to said cup.

13. An internal combustion engine having a fuel delivery system for delivering fuel to said engine, said engine including:

an engine block with a combustion chamber;

a fuel rail having a cup outlet, said cup having a flange;

a fuel injector having a body with an inlet insertable within said cup;

an arcuate clip having an outer peripheral surface for insertion within said cup and an inner peripheral surface for non-relative tortional engagement with said fuel injector body, said clip having a radially outward extending arm with a contact surface with engagement with said cup flange to limit radial movement of said clip with respect to said cup.

14. An internal combustion engine as described in claim 13 wherein said extending arm of said clip limits axial movement of said clip with respect to said cup.

15. A clip for a fuel delivery system, said fuel delivery system including a fuel rail having a flanged cup outlet, and said fuel delivery system having a fuel injector having a body with an inlet insertable within said cup outlet, said clip comprising:

an arcuate body having an outer peripheral surface for insertion within said cup, said clip having an inner peripheral surface for non-relative tortional engagement with said fuel injector body and said clip having a radially extending arm with a contact surface for engagement with said cup flange to limit axial movement of said clip with respect to said cup.

16. A clip for a delivery system as described in claim 15 wherein said clip arm has a contact surface for engagement with said cup flange to limit radial movement of said clip with respect to said cup.

17. A fuel delivery system as described in claim 1 wherein said cup has a projection to provide a contact surface to make contact with said radially extending arm of said clip to prevent radial movement of said clip with respect to said cup.

18. A fuel delivery system as described in claim 1 wherein said clip has a wishbone bend.

19. A fuel delivery system as described in claim 1 wherein said clip has a bent over finger to extend over said flange.

* * * * *